US008403440B2

(12) United States Patent
Williams et al.

(10) Patent No.: US 8,403,440 B2
(45) Date of Patent: Mar. 26, 2013

(54) DRIVING WAVEFORM FOR DROP MASS AND POSITION

(75) Inventors: Brian Edward Williams, Woodburn, OR (US); Terrance Lee Stephens, Molalla, OR (US)

(73) Assignee: Xerox Corporation, Norwalk, CT (US)

( * ) Notice: Subject to any disclaimer, the term of this patent is extended or adjusted under 35 U.S.C. 154(b) by 257 days.

(21) Appl. No.: 12/370,539

(22) Filed: Feb. 12, 2009

(65) Prior Publication Data

US 2010/0201725 A1 Aug. 12, 2010

(51) Int. Cl.
*B41J 29/38* (2006.01)

(52) U.S. Cl. ..... 347/11; 347/12; 347/5

(58) Field of Classification Search ..... 347/5, 10–11, 347/9, 12
See application file for complete search history.

(56) References Cited

U.S. PATENT DOCUMENTS

| | | | | |
|---|---|---|---|---|
| 6,099,103 | A * | 8/2000 | Takahashi | 347/11 |
| 7,021,733 | B2 | 4/2006 | Darling | |
| 2004/0085374 | A1 | 5/2004 | Berger et al. | |
| 2006/0082608 | A1 | 4/2006 | Berger et al. | |

* cited by examiner

*Primary Examiner* — Lam S Nguyen
(74) *Attorney, Agent, or Firm* — Marger Johnson & McCollom PC

(57) ABSTRACT

A drop emitting device that includes a drop generator, a drive signal including a plurality of fire intervals applied to the drop generator, wherein the drive signal includes in each fire interval a bi-polar drop firing waveform or a non-firing waveform.

18 Claims, 3 Drawing Sheets

DRIVING WAVEFORM FOR DROP MASS AND POSITION

BACKGROUND

Drop on demand ink jet technology for producing printed media has been employed in commercial products such as printers, plotters and facsimile machines. Generally, an ink jet image is formed by selective placement on a receiver surface of ink drops emitted by a plurality of drop generators implemented in a printhead or a printhead assembly. For example, the printhead assembly and the receiver surface are caused to move relative to each other and drop generators are controlled to emit drops at appropriate times, for example by an appropriate controller. The receiver surface may be a transfer surface, the image printed upon it is subsequently transferred to an output print medium such as paper.

A known ink jet drop generator structure employs an electromechanical transducer to displace ink from an ink chamber in a drop forming outlet passage, and it may be difficult to control drop velocity and/or drop mass.

DETAILED DESCRIPTION

Figure 1:
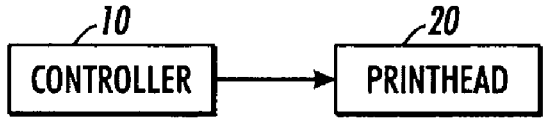
FIG. 1 shows a schematic block diagram of an embodiment of a drop-on-demand drop emitting apparatus.

FIG. 1 shows a schematic block diagram of an embodiment of a drop-on-demand printing apparatus that includes a controller 10 and a printhead assembly 20 that may include a plurality of drop emitting drop generators. The controller 10 selectively energizes the drop generators by providing a respective drive signal to each drop generator. Each of the drop generators may employ a piezoelectric transducer. As other examples, each of the drop generators may employ a shear-mode transducer, an annular constrictive transducer, an electrorestrictive transducer, an electromagnetic transducer, or a magnetorestrictive transducer. The printhead assembly 20 may be formed of a stack of laminated sheets or plates such as of stainless steel.

Figure 2:
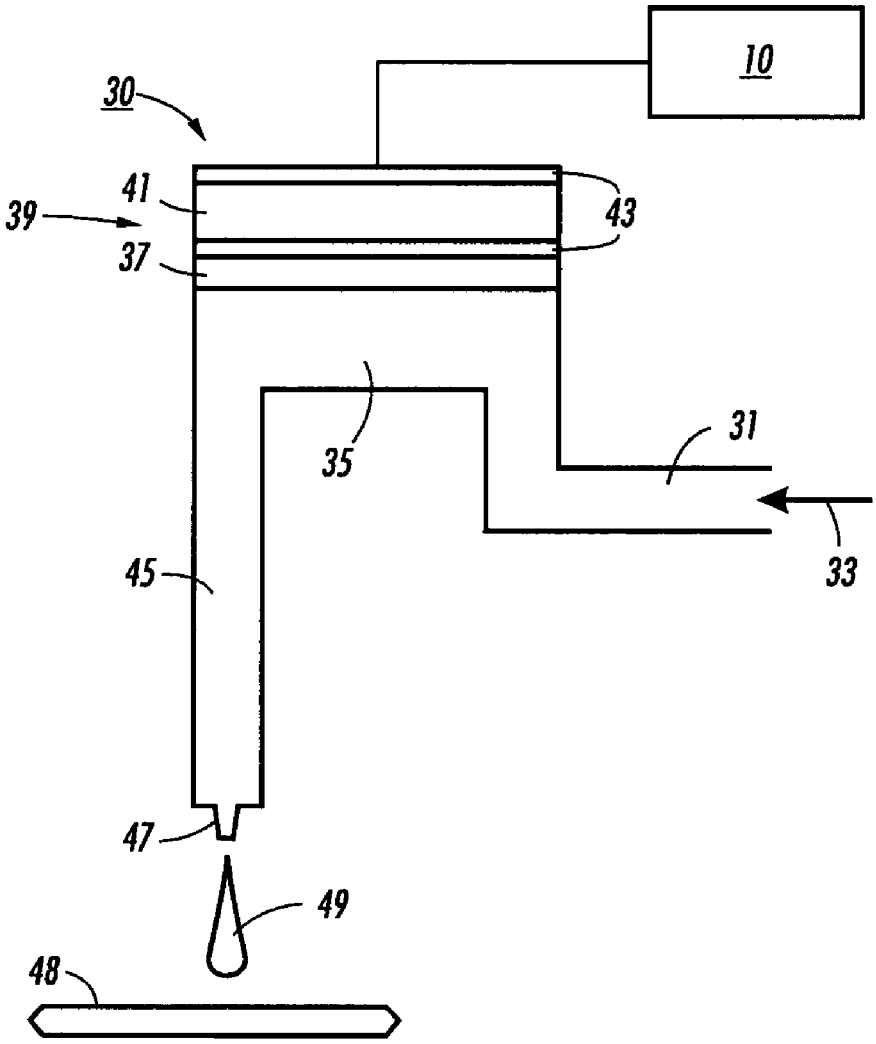
FIG. 2 shows a schematic block diagram of an embodiment of a drop generator.

FIG. 2 is a schematic block diagram of an embodiment of a drop generator 30 that may be employed in the printhead assembly 20 of the printing apparatus shown in FIG. 1. The drop generator 30 includes an inlet channel 31 that receives ink 33 from a manifold, reservoir or other ink containing structure. The ink 33 flows into a pressure or pump chamber 35 that is bounded on one side, for example, by a flexible diaphragm 37. An electromechanical transducer 39 is attached to the flexible diaphragm 37 and may overlie the pressure chamber 35, for example. The electromechanical transducer 39 may be a piezoelectric transducer that includes a piezo element 41 disposed for example between electrodes 43 that receive drop firing and non-firing signals from the controller 10. Actuation of the electromechanical transducer 39 causes ink to flow from the pressure chamber 35 to a drop forming outlet channel 45, from which an ink drop 49 is emitted toward a receiver medium 48 that may be a transfer surface, for example. The outlet channel 45 may include a nozzle of orifice 47.

The ink 33 may be melted or phase changed solid ink, and the electromechanical transducer 39 may be a piezoelectric transducer that is operated in a bending mode, for example.

Figure 3:
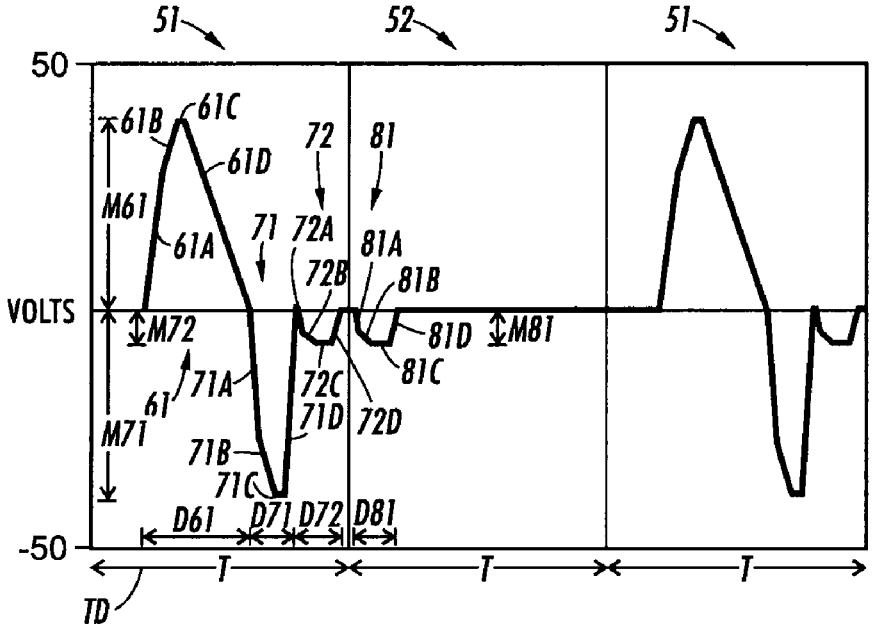
FIG. 3 shows a schematic depiction of an embodiment of a drive signal.

FIG. 3 is a schematic diagram of an example of a drive signal D for energizing the drop generator of FIG. 2. The drive signal D includes a plurality of sequential fire intervals TD of time duration T, and within each fire interval TD the drive signal D includes either a time varying drop firing signal or waveform 51, or a time varying non-firing signal or waveform 52. The time varying drop firing waveform 51 is shaped or configured to actuate the electromechanical transducer such that the drop generator emits an ink drop, while the non-firing waveform 52 is shaped or configured to perturb the electromechanical transducer without causing a drop to be emitted. As an example, the firing interval duration T may be in the range of about 1000 microseconds to about 23 microseconds, such that the drop generator may be operated in a range of about 1 kHz to about 43 kHz.

The time varying non-firing waveform may be configured to set the condition of the drop generator 30 for the next fire interval. For example, the time varying non-firing waveform 52 may be shaped or configured to place the drop generator 30 in an electromechanical and fluid dynamics condition similar to the electromechanical and fluid dynamics condition the drop generator 30 would be in after firing a drop. In this manner, the drop generator 30 is placed in substantially the same electromechanical and fluid dynamics condition each time the drop generator fires, which may provide for more consistent drop velocity and/or drop mass over a broad range of operating conditions.

As another example, the time varying non-firing waveform 52 may be shaped or configured to reduce variation in drop velocity such that drop velocity is approximately constant regardless of whether a given drop firing waveform follows a drop firing waveform or a non-firing waveform. In other words, the drop velocity is not substantially affected by the firing pattern.

Also, the time varying non-firing waveform 52 may be shaped or configured to reduce variation in drop mass such that drop mass is approximately constant regardless of whether a given drop firing waveform follows a drop firing waveform or a non-firing waveform. In other words, drop mass is not substantially affected by the firing pattern.

The time varying non-firing waveform 52 may further be shaped or configured to change a drop parameter when a given drop firing waveform follows a non-firing waveform.

As an example, as depicted in FIG. 3, the time varying drop firing waveform 51 may be a bi-polar voltage signal having a component that is greater than 0 volts and a component that is less than 0 volts. Alternatively, the time varying drop firing waveform may be a signal that includes a pulse component that is greater than a reference and a pulse component that is less than the reference.

The time varying non-firing waveform may be a uni-polar voltage signal such as a pulse that may be positive or negative, for example relative to a reference. A non-firing pulse may have a pulse duration that is less than a fire interval, for example, wherein pulse duration may be measured for convenience between pulse transition times, which is the transition from the reference and the transition to the reference). A non-firing pulse may be located anywhere in a fire interval. For example a non-firing pulse may be approximately centered in a fire interval or it may be located only in either the first half or the second half of a fire interval. By way of specific example, the time varying non-firing waveform may be a negative going pulse having a width that is in the range of about 10% to about 90% of the firing interval T, or about 0.1 T to about 0.9 T as an example.

As an example, as depicted in FIG. 3, the time varying drop firing waveform 51 may be a bi-polar voltage signal having in sequence a positive pulse component 61, a first negative pulse component 71, a delay, and a second negative pulse component 72. The time varying non-firing waveform contains a negative pulse 81. Each pulse is characterized by a pulse duration D61, D71, D72, and D81 which for convenience is measure between the pulse transition times, which are the transitions from the reference and the transition to the reference. Each pulse is characterized by a peak pulse magnitude M61, M71, M72, and M81 which is a positive number in this example.

The positive pulse 61 may have a duration D61 in the range of about 7 microseconds to about 12 microseconds. The first negative pulse 71 may have a duration D71 in the range of about 3 microseconds to about 6 microseconds. The second negative pulse 72 may have a duration D72 in the range of about 3 microseconds to about 5 microseconds. The negative pulse 81 of the time varying non-firing waveform 52 may have a duration D81 in the range of about 3 microseconds to about 5 microseconds.

The positive pulse 61 may have a peak magnitude M61 in the range of about 30 volts to about 50 volts. The positive pulse may include, for example, four segments: a first positive going segment 61A, a second positive going segment 61B, a substantially constant level segment 61C, and a negative going segment 61D. The first positive going segment 61A is steeper than the second positive going segment 61B and the negative going segment 61D is less steep than both positive going segments of positive pulse 61.

The first negative pulse 71 may have a magnitude M71 in the range of about 30 volts to about 50 volts. The first negative pulse may include, for example, four segments: a first negative going segment 71A, a second negative going segment 71B, a substantially constant level segment 71C, and a positive going segment 71D. The first negative going segment 71A is steeper than the second negative going segment 71B and the negative going segment 71D is steeper than the second negative going segment 71B of the first negative pulse 71.

In operation, the third pulse 72 of the time varying firing waveform 51 resets the meniscus of the drop generator 30 to prepare it for the next firing interval. This third pulse 72 leaves the drop generator 30 in a desired resonant state. The voltage and timing of the third pulse 72 may affect the electromechanical and fluid dynamic resonant state of the drop generator 30. The voltage of the third pulse may be selected for a specific drop mass difference between drops emitted at a given frequency or corresponding image pattern and drops emitted at a different frequency or image pattern.

For example, the polarity of the third pulse 72 and the magnitude of the voltage of the third pulse 72 relative to the voltage of the first pulse 61 may be adjusted from about 0% to about 50% in both polarities for a specific difference in drop mass during operation when the drop generator 30 is controlled in such a way as to emit drops at a given firing frequency as compared to the drop mass generated when the drop generator 30 is controlled in such a way as to emit drops at a different firing frequency. For example, the magnitude of the third pulse 72 of the time varying firing waveform 51 may be set from about −50% voltage compared to the magnitude of the first positive pulse 61 to about 50% voltage compared to the magnitude of the first positive pulse 61 for a desired drop mass difference between drop emitted at about 43 kHz compared to drops emitted at about 11 kHz or drops emitted as a pattern with an approximate fire rate of 11 kHz.

The third pulse 72 of the time varying firing waveform 51 may have a peak magnitude M72 that is in the range of about 15 volts or less. As an example, as depicted in FIG. 3, the third pulse of the time varying firing waveform 72 may have a relative magnitude compared to the first positive pulse 61 in the range between −50% and 0%. The third pulse 72 of the time varying firing waveform 51 may include, for example, four segments: a first negative going segment 72A, a second negative going segment 72B, a substantially constant level segment 72C, and a positive going segment 72D. The first negative going segment 72A is steeper than the second negative segment 72B and the positive going segment 72D is steeper than the second negative going segment 72B.

Figure 4:
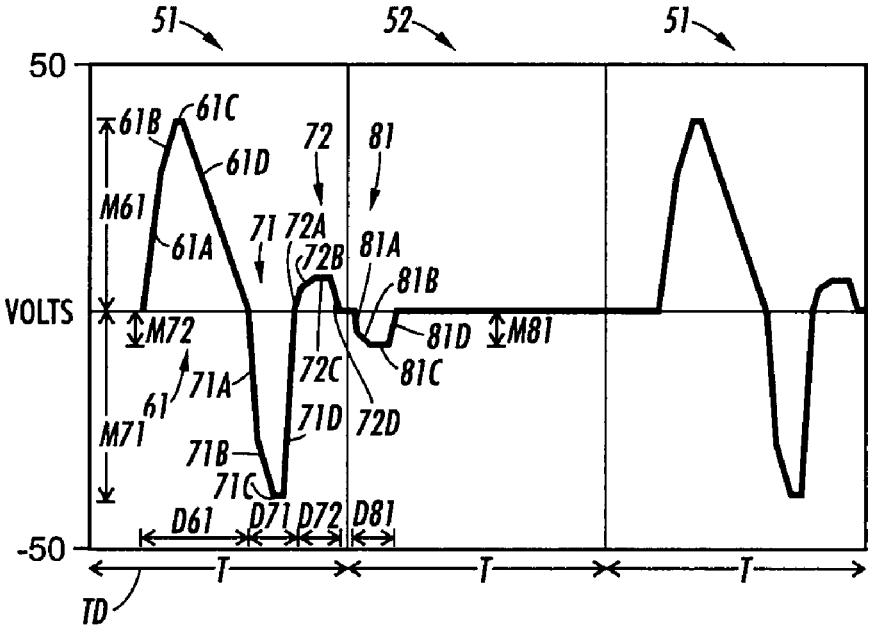
FIG. 4 shows a schematic depiction of another embodiment of a drive signal.

As an example, as depicted in FIG. 4, the third pulse of the time varying firing waveform 72 may have a relative magnitude compared to the first positive pulse 61 in the range between 0% and 50%. The third pulse 72 of the time varying firing waveform 51 may include, for example, for segments: a first positive going segment 72A, a second positive going segment 72B, a substantially constant level segment 72C, and a negative going segment 72D. The first positive going segment 72A is steeper than the second positive segment 72B and the negative going segment 72D is steeper than the second positive going segment 72B.

The negative pulse 81 of the time varying non-firing waveform 52 may have a magnitude in the range of about 5 volts to about 10 volts. The negative pulse 81 of the time varying non-firing waveform 52 may include, for example, four segments: a first negative going segment 81A, a second negative going segment 81B, a substantially constant level segment 81C, and a positive going segment 81D. The first negative going segment 81A is steeper than the second negative segment 81B and the positive going segment 81D is steeper than the second negative going segment 81B.

Figure 5:
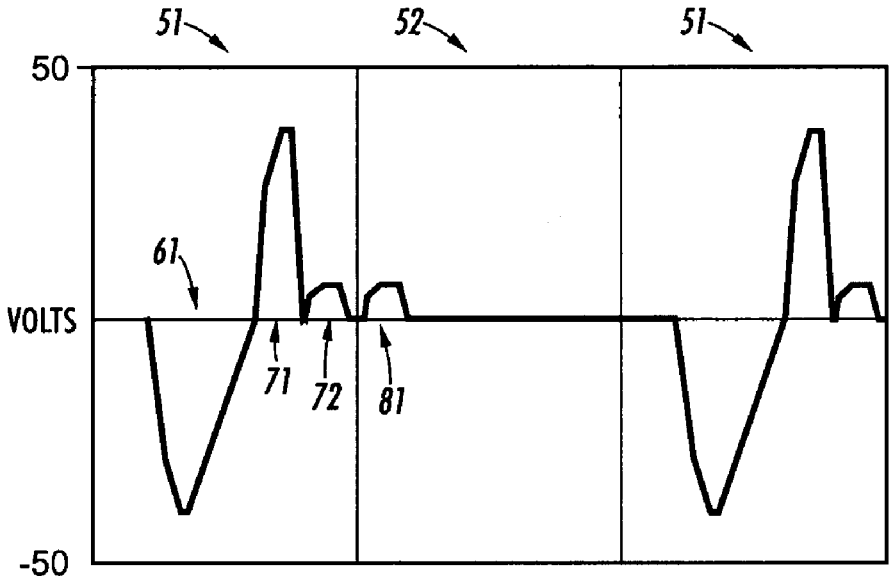
FIG. 5 shows a schematic depiction of a further embodiment of a drive signal.
Figure 6:
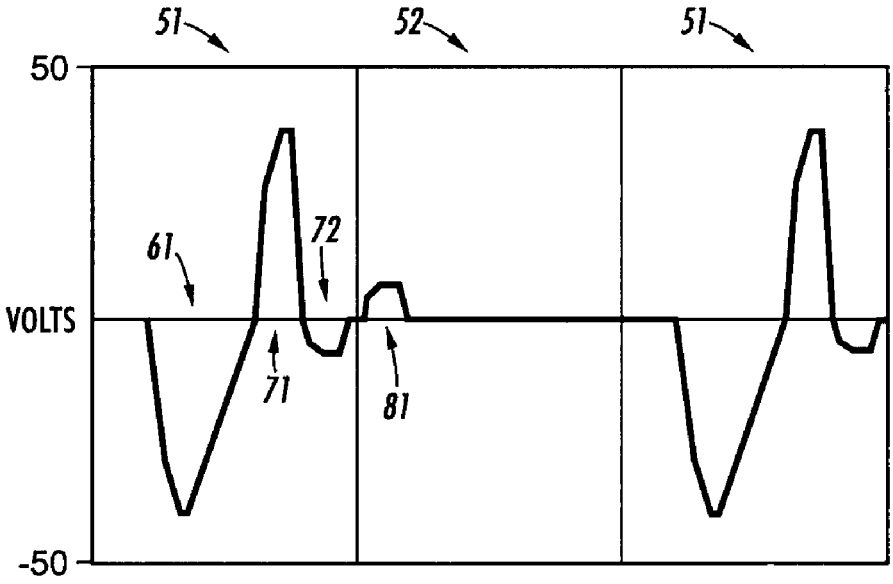
FIG. 6 shows a schematic depiction of another embodiment of a drive signal.

Generally, the firing waveform 51 will comprise, in sequence, a first pulse having a first polarity, a second pulse having a second polarity, a delay, and a third pulse having a first or second polarity. Similarly, the non-firing waveform 52 will generally comprise a pulse having a second polarity relative to the firing waveform 51. FIGS. 5 and 6 are schematic diagrams of embodiments of drive signals that may be employed to drive a drop generator similar to that of FIG. 2 that are of an opposite polarity from the waveforms of FIGS. 3 and 4. The waveforms of FIGS. 5 and 6 comprise a negative pulse 61, a positive pulse 71, a positive and negative third pulse 72 of the firing waveform respectively, and a positive non-firing pulse 81. The durations D61, D71, D72, D81 and magnitudes M61, M71, M72, M81 of the pulses of the firing and non-firing waveforms of FIGS. 5 and 6 may be substantially the same as the durations D61, D71, D72, D81 and magnitudes M61, M71, M72, M81 of the corresponding pulses in the waveforms of FIGS. 3 and 4.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A drop-emitting apparatus, comprising:

a drop generator;

a drop generating waveform applied to the drop generator during a firing interval if a drop is to be emitted, the drop generating waveform comprising a pulse having a first polarity followed by a pulse having a second polarity followed by a third pulse of either the first or second polarity and magnitude of fifty percent or less than the pulse of the first polarity; and a non-drop generating waveform applied to the drop generator during the non-firing interval if a drop is not to be emitted, the non-drop generating waveform comprising a single pulse having the second polarity, the single pulse having a duration in a same range of the third pulse, wherein the third pulse and the single pulse each have four segments, the single pulse having a first negative going segment, a second negative going segment, a substantially constant level segment, and a positive going segment.

2. The drop-emitting apparatus of claim 1, the first pulse selected to cause the drop generator to intake fluid into a pressure chamber.

3. The drop-emitting apparatus of claim 1, the second pulse selected to cause the drop generator to emit fluid from a pressure chamber.

4. The drop-emitting apparatus of claim 1, the third pulse selected to maintain the drop generator in a desired resonant state.

5. The drop-emitting apparatus of claim 1, the third pulse selected to meet a desired drop mass difference between drops generated for two different image patterns.

6. The drop-emitting apparatus of claim 1, wherein the drop non-firing waveform comprises a single pulse of a polarity opposite a polarity used to cause the drop generator to emit a fluid.

7. The drop-emitting apparatus of claim 1, wherein the drop non-firing waveform comprises more than one pulse.

8. The drop-emitting apparatus of claim 1, wherein the drop non-firing waveform occurs in a first portion of the firing interval.

9. The drop-emitting apparatus of claim 1, the drop non-firing waveform selected to reset a meniscus based upon a correct startup drop mass and velocity response.

10. A drop-emitting apparatus, comprising:

a drop generator;

a drop firing waveform applied to the drop generator applied during a firing interval if a drop is to be fired, the drop firing waveform comprising a pulse having a first polarity followed by a pulse having a second polarity followed by a pulse having one of the first or second polarity and a magnitude of fifty percent or less of the pulse having the first polarity; and a drop non-firing waveform applied to the drop generator during the firing interval if the drop is not to be fired, the drop non-firing waveform having a pulse of the second polarity and a magnitude of fifty percent or less of the pulse having the first polarity and having a duration in a same range as the pulse in the firing waveform having a magnitude of fifty percent or less of the pulse having the first polarity, wherein the pulse having one of the first or second polarity in the firing waveform and the pulse of the second polarity in the non-firing waveform each have four segments, the pulse of the second polarity having a first negative going segment, a second negative going segment, a substantially constant level segment, and a positive going segment.

11. The drop-emitting apparatus of claim 10, wherein the drop firing waveform comprises the first pulse having a positive polarity, the second pulse having a negative polarity and the third pulse having one of either a positive or negative polarity.

12. The drop-emitting apparatus of claim 10, wherein the drop firing waveform comprises the first pulse having a negative polarity, the second pulse having a positive polarity and the third pulse having one of either a positive or negative polarity.

13. The drop-emitting apparatus of claim 10, wherein the non-firing waveform comprises a single voltage pulse.

14. The drop-emitting apparatus of claim 10, wherein the non-firing waveform comprises more than one voltage pulse.

15. The drop-emitting apparatus of claim 10, wherein the non-firing waveform has a magnitude of less than or equal to 10 volts.

16. The drop-emitting apparatus of claim 10, the drop firing waveform occurring after a delay interval within the firing interval.

17. The drop-emitting apparatus of claim 16, wherein the delay interval is between four and 5 microseconds.

18. The drop-emitting apparatus of claim 10, wherein the non-firing waveform occurs within 1 microsecond of the beginning of the firing interval.

* * * * *